United States Patent [19]

Antunez

[11] Patent Number: 4,840,196

[45] Date of Patent: Jun. 20, 1989

[54] BI-STABLE, THREE CONDITION FLUSH TANK SYSTEM

[76] Inventor: Bruce A. Antunez, 1143 Indian Springs Dr., Glendora, Calif. 91740

[21] Appl. No.: 205,267

[22] Filed: Jun. 10, 1988

[51] Int. Cl.[4] ..... F16K 31/18; F16K 33/00

[52] U.S. Cl. ..... 137/410; 4/378; 4/415; 137/426; 137/441; 138/121

[58] Field of Search ..... 4/300, 378, 415; 138/119, 120, 121; 137/409, 410, 426, 436, 441

[56] References Cited

U.S. PATENT DOCUMENTS

| | | | |
|---|---|---|---|
| 958,734 | 5/1910 | Duncan | 4/384 |
| 1,282,499 | 10/1918 | Teschan | 4/384 |
| 2,173,070 | 9/1939 | Brown | 137/441 |
| 2,807,024 | 9/1957 | Kapp | 446/320 |
| 4,106,136 | 8/1978 | Lippincott, Sr. | 4/378 |
| 4,108,202 | 8/1978 | Schoepe | 137/436 |
| 4,216,801 | 8/1980 | Aykanian | 138/121 |
| 4,341,238 | 7/1982 | Roosa et al. | 137/410 |
| 4,351,071 | 9/1982 | Clar | 4/384 |
| 4,399,835 | 8/1983 | Holderith | 137/426 |
| 4,593,690 | 6/1986 | Sheridan et al. | 138/121 |

*Primary Examiner*—George L. Walton
*Attorney, Agent, or Firm*—Donald D. Mon

[57] ABSTRACT

A flush valve system for a water storage tank. The system includes a standpipe which establishes both an upper water level and a repose water level. A tank valve receives water for the tank. It includes bi-stable control means which retains the most recent condition pertaining to a level higher than the repose level, or a lower level respective to drainage of stored water. The valve will therefore remain closed while the water is drained, until the water level reaches the lower level. The standpipe may include foldable segments which enable its length to be adjustably varied.

12 Claims, 1 Drawing Sheet

BI-STABLE, THREE CONDITION FLUSH TANK SYSTEM

SPECIFICATION

1. Field of the Invention

This invention relates to flush tank systems of the type which store water to be released for a flushing cycle, and which during the cycle accumulate water for the next flush and also provide water to a next assembly such as a toilet bowl.

2. Background of the Invention

A classical flushing system as is used in commodes includes a storage tank with a capacity sufficient to swamp a siphon air break and flush away materials in the commode itself. These systems require a flush valve which is opened on demand to discharge water into the commode for that purpose, and a tank valve which opens when the tank is filled to less than some level to refill the tank after the previously stored water has been discharged. This relationship between the tank and the flushing operation is straightforward and well known.

However, these systems also require refilling the a next assembly, such as a toilet bowl to some level. The refilling of this bowl is not generally monitored by the two valves which attend to the tank. Instead it is customary to provide a bowl fill tube which takes a portion of the water from the tank valve and convey it to the bowl. A metering valve is placed in this bowl fill line and is adjusted so that if everything remains in perfect adjustment, the bowl will be properly filled by the time the tank itself is properly refilled. Such a system is usually characterized by a water line tapped from the tank valve, which discharges into the bowl through an overflow pipe associated with the flush valve.

This is a system which is accepted and valided by decades of usage in many millions of commode installations. The instant invention cannot be expected to supplant this conventional system in its entirety, but the conventional system does have disadvantages characterized by requiring structure which this invention renders unnecessary, and by excessive use of water which this invention can at least reduce.

Among the inherent disadvantages of the prior art systems is that there are so many independent and interdependent functions which simultaneously occur. For one example, it is conventional practice to connect the tank valve through a bypass to the discharge end of the flush valve to refill the bowl. This requires a line, to convey the water, and an adjustable metering valve to adjust the flow. The metering valve and the tube are both a cost and a complication.

Beyond that as an objection is the fact that any setting of the tank valve does not necessarily assure that there will be an exact quantity of water provided to the bowl itself. This is because the volume of flow is time related and also supply-pressure related. Also the operation of the two valves overlaps, so that whatever variables either has is compounded by the other.

It is an object of this invention to provide a three condition flush tank valve system which does not require conduitry between the tank valve and the flush valve in order to refill the bowl. This eliminates the requirement for the conduitry and for adjustable valve to adjust flow through it.

Another object of this invention is to provide a system in which there is no necessary overlap between the draining of the tank and the actions of refilling the tank and bowl, whereby to avoid the uncertainties inherent in the simultaneous flow through the tank valve which supplies the tank and the flush valve which drains it.

In addition to the dynamic flow problems inherent in these systems is an inherent difficulty in adjusting the tank level when full, the necessary overflow level and the tank valve itself. Customarily the maximum height in the tank is determined by a standpipe which discharges through the flush valve itself. The ultimate height of the water in the tank when full is often adjusted by bending the linkage between the valve and a responsive float acting as a level sensor. As a consequence, the standpipe becomes no more than a safety overflow required by codes, and the ultimate level in the tank is determined by the condition of the linkage between the tank valve and its associated float. Accordingly such a system becomes largely one in which there is an outlet flush valve and a toilet tank valve which are not directly related to one another, and in which the bowl is refilled through a bowl fill line which has no inherent relationship to either of these valves. The possible consequences for wastage of water and the requirement for additional controls are evident.

It is an object of this invention to overcome these limitations, to require a minimum of structure, and to provide a system in which the tank level and the bowl fill level are uniquely related to an extension of the flush valve, and in which a bi-stable toilet tank valve enables the bowl fill and the refill of the tank to occur independently of intermediate tank level conditions.

BRIEF DESCRIPTION OF THE INVENTION

A flush tank system according to this invention includes a tank adapted to store water at and below a given level. The tank has an inlet and an outlet, the outlet being fitted with a flush valve which when opened allows water above it to be drained into the commode or what ever the next assembly is. This flush valve includes and is bypassed by the standpipe which rises in the tank and which has a pair of reference levels. The first level is a cutoff level and the second is a repose level.

The inlet to the tank is fitted with a tank valve which receives water from a water supply and discharges it into the tank. Sensor means is responsive to the level in the tank and is so disposed and arranged relative to the tank valve as to be reactive to the tank valve at a lower and at an upper water level in the tank. The tank valve is bi-stable in that it is stable in either of these positions until the other is reached. A repose level in the tank is at level between the upper and lower level.

According to another feature of the invention, the upper end of the standpipe is vertically adjusted so as itself to adjust the upper level attainable in the tank and with it the repose level.

According to a preferred but optical feature of the invention, the adjustability of the standpipe is obtained by utilizing a material whose axial length can inherently be adjusted such as by folding or sliding.

Yet another optional feature of the invention is to provide the standpipe as a flexible member, the elevation of whose upper end is adjusted by stand means.

The above and other features of this invention will be fully understood from the following description and the accompanying drawings in which:

DETAILED DESCRIPTION OF THE INVENTION

Figure 1:
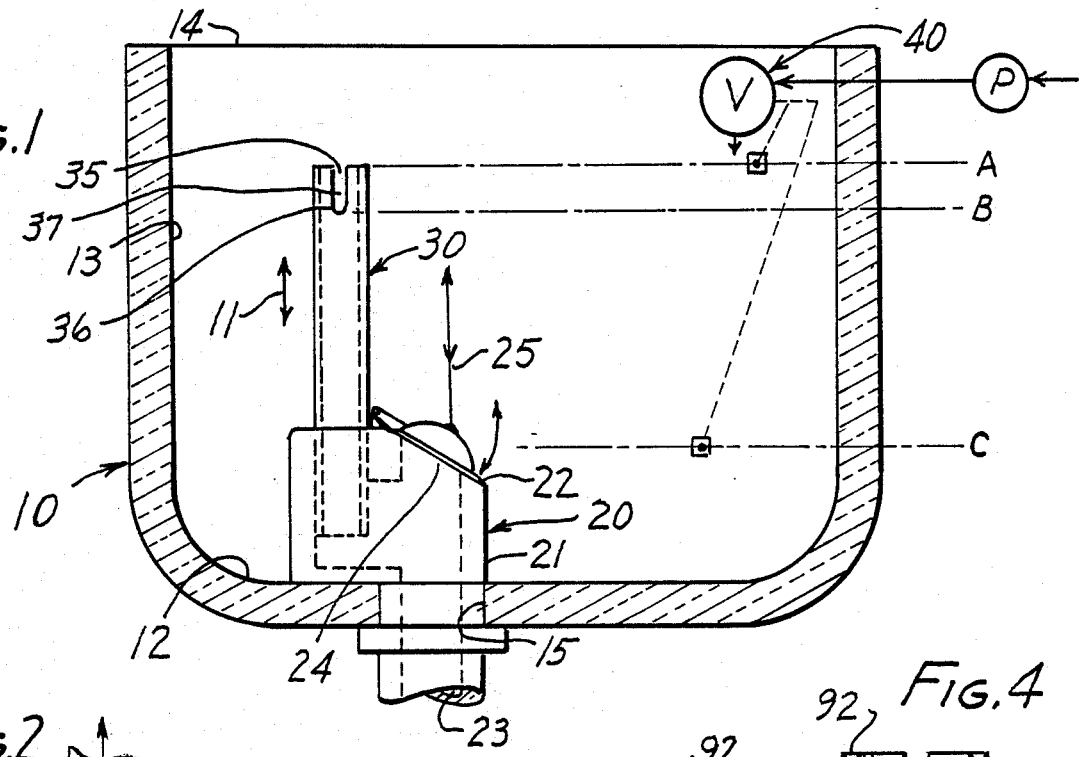
FIG. 1 is a cross-section partly in schematic notation showing the presently preferred embodiment of the invention.

FIG. 1 shows a water storage tank 10 with a vertical storage axis 11, a bottom 12, sides 13 and top 14. A drain port 15 is formed in the bottom.

The function of the tank is to store water for a next flush cycle, and before returning to its repose condition, to discharge water for this purpose, to discharge water to refill the toilet bowl, and to refill the tank to a repose level.

A flush valve 20 is fitted in the drain port. It has a body 21 with a passage from a seat 22 to outlet port 23. A flapper seal 24 is hinged to the body, and when closed is seated on the seat 22 to close it. Starting a cycle is done by pulling upward on a linkage 25 to lift the flapper seal off the seat. Known flappers remain open by flotation or otherwise until the tank is emptied. One well-known example is shown in Antunez U.S. Pat. No. 4,365,365, which is incorporated herein by reference in its entirety for its showing of a suitable flapper valve.

A standpipe 30 rises from the body. It is required by building codes, and generally has an inside diameter of one inch or greater. It acts as overflow protection, its upper end 31 being at lever A (which may also be the shut-off level herein), which is the maximum level to which water can rise in the tank. Additional water flows through the standpipe directly to the inlet port and to the commode.

In accordance with this invention, a drain port 35 is formed at the upper end of the standpipe. It has a lowermost open extreme 36, which in the example is the lower end of a slot 37 through the wall of the standpipe that extends down from the upper end of the standpipe. At least where no more water is being added, and water has risen above repose level B, water in the tank will drain through port 35 into the bowl to fill it. Instead of a continuous slot from the top, one or more holes can be formed through the standpipe wall, the lowermost hole determining level B, but a slot or slots have the advantage of quicker repose drainage.

A tank valve 40 is schematically shown. It may be any type of off-on valve, mechanically or hydraulically controlled. It is a bi-stable valve whose off or on condition is maintained until a next event occurs to change it. In this regard it differs significantly from conventional ballcock tank valves in which the valve is shut off only when the water level is as high or higher as above maximum level, and is open at all lower levels.

The instant valve closes when the water level reaches an uppermost level A, which may or may not be at the upper end of the standpipe. The valve *remains closed* until the water level reaches level C. The fact that the water level may be at some intermediate level such as repose level B does not open the valve. Level A is always above level B.

Similarly, once the tank valve has opened as the consequence of the water level's having lowered to level C, it will remain open until water again reaches level A.

In both settings, the fact that the water level has been at level B, in either a rising or falling movement, has no effect on the tank valve setting. The term "bi-stable" describes this situation, where the valve setting respective to a previous operation condition remained until the attainment of the next operative condition, where it switches over.

Thus when the water level has risen to level A, the tank valve shuts off. Water can drain through the slot until it reaches level B, and the valve remains shut. This water is in an amount needed to refill the bowl. It will have been supplemented by a minor flow through the slots while the level rose from level B to level A, but this is a small percentage of the total flow to the bowl for refill purposes.

Level B is the repose condition, and the tank valve will remain closed until the water level falls to level C. This occurs after the flush valve has been opened. However, notice that while the water level falls from level B to level C, the tank valve has remained closed. A precise volume of water, namely that stored in the tank between levels B and C is discharged, and nothing from the tank valve. This precise volume discharged into the commode driving the flush cycle is totally independent of the water supply pressure. If course it is possible and within the scope of this invention to open the tank valve while the level is still falling, but this would rarely be desirable.

The volume discharged to refill the bowl at repose can be made substantially independent of anything except the volume contained in the tank between levels A and B.

Importantly, the elevation C where the tank valve is opened can be selected to be where the flush valve closes. This eliminates overlap of the valve functions. Again, overlap can be permitted if desired.

Figure 6:
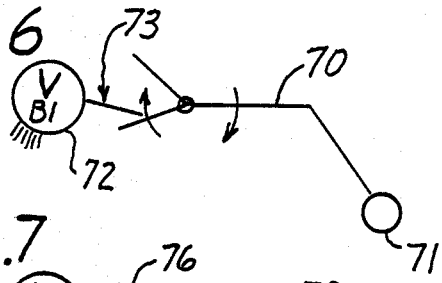
FIGS. 6 and 7 are schematic notations showing the bi-stable operation of the valve in FIG. 1.
Figure 7:
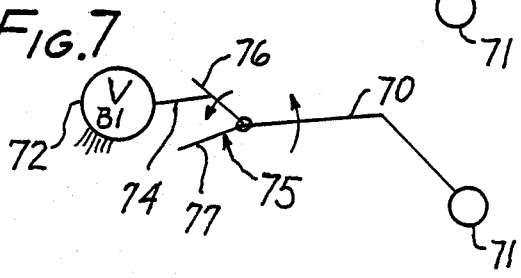
Figure 8:
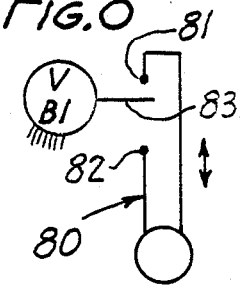
FIG. 8 is another example of another control arrangement for a bi-stable valve.

FIGS. 6 and 7 schematically show a valve control in the form of a float linkage 70 pivotally mounted to the tank. It includes a float 71 that follows the water level. Tank valve 72 has an actuator 73 in the nature of a feeler 74 that assumes only two positions, respective to open and closed. A fork 75 has fingers 76, 77 which are part of the linkage, and these fingers change the setting of the feeler when the level is at the higher or lower extremes. FIG. 6 shows the valve about to be shut in a falling level, and FIG. 7 shows it about to be opened in a rising level. FIG. 8 shows an actuator 80 with contactors 81, 82 spaced apart to move filler 83 of tank valve 84 at levels A and C.

Level C is basically fixed in any tank installation, because it relates to structure of the flush valve which is installed in the tank bottom.

The difference between levels A and B is constant, being determined by the distance from the standpipe to the lowest point of the drain port.

The elevation of level A is set by adjusting the linkage or control position of the tank valve, but this does not coordinate with an adjustment of level B when the standpipe is rigid and fixed. Therefore it is advantageous to be able to move the upper end of the standpipe up and down, which will adjustably establish both levels A and B.

Figure 2:
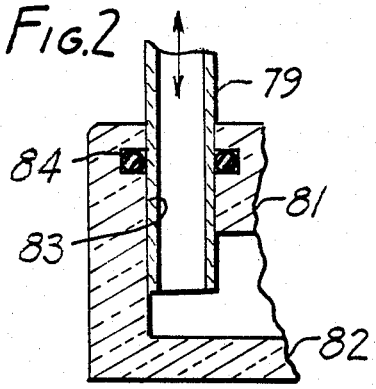
FIG. 2 is a schematic cross-section of one embodiment of a portion of FIG. 1.

FIG. 2 shows standpipe 79 so fitted in body 81 of a flush valve 82. It enters the body through a passage 83 with a peripheral seal 84. The outside wall 85 of the standpipe is cylindrical, so that a seal is maintained in all positions of the standpipe. It can be moved up and down as shown by arrow 86. Its upper end is provided with drain means as in the embodiment of FIG. 1.

Figure 3:
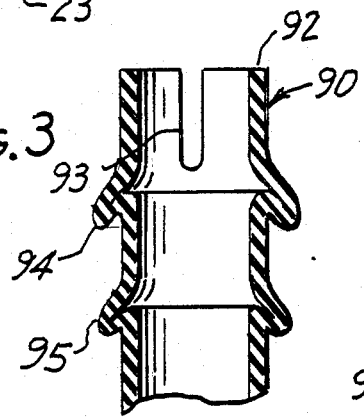
FIGS. 3 and 4 are axial cross-sections showing two conditions of another embodiment of the standpipe of FIG. 1.
Figure 4:
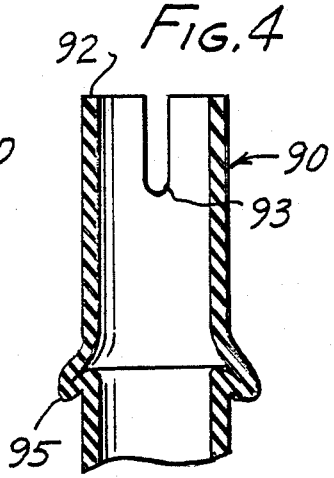

FIGS. 3 and 4 show another embodiment of standpipe 90. It is fixed to the body of the flush valve and discharges therein, as in the other embodiments. Its upper end 92 has a drain slot 93 as in FIG. 1. This is a well known tubing whose axial length can be adjusted by folding or unfolding re-entrante convolutions 94, 95 which extend around the pipe at established spacings. In FIG. 3, both convolutions are folded. The pipe is shorter. In FIG. 4 convolution 94 has been unfolded and the pipe as longer. Thus, the elevation of level A can be adjusted by folding or unfolding the convolutions to length or shorter the pipe. An example of such a tubing is shown in Morrison U.S. Pat. No. 3,645,038, which is incorporated herein by reference.

Figure 5:
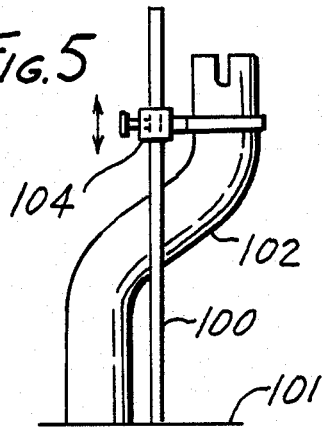
FIG. 5 is a fragmentary illustration of yet another means to adjust the elevation of the standpipe.

FIG. 5 shows a support rod 100 mounted to the body 101 of a flush valve. A flexible standpipe 102 discharges into the body, and is held with its upper slotted end at a selected elevation by a clamp 104 held to the post. Adjustment of levels A and B are made by moving the clamps up and down the post.

The upper end of the standpipe constitutes the upper most level A. When the bowl fill volume is that which refers to the difference in the tank volume between the upper of the pipe and the lower edge of the slot, the tank valve will be adjusted so it shuts off when the water level reaches the other end. If a different bowl fill volume is desired, then level B is adjusted by the pipe position, and level A by setting the tank valve to close at a level below the upper end. What is noteworthy is that nearly exact volumes of bowl fill water can be selected in this way, regardless of water pressure or flow rates. Naturally the supply rate through the tank valves must exceed the drain capacity of the slot, but this is a simple matter of dimension selections.

There may be circumstances where the concurrent flow through both valves is acceptable and perhaps also desirable. In that event this invention will still provide the certainty of bowl refill volume, and freedom from a bowl fill line and adjustable bleed valve. In that event it is only necessary to establish level C closer to level B, so that the valve turns on shortly before the level falls to the illustrated level C. Thus this invention contemplates the use of any type of tank valve which shuts off at an upper tank level and is at repose at a lower repose level, utilizing a standpipe with drainage means spaced from its upper end.

This invention is not to be limited by the embodiments shown in the drawings and described in the description, which are given by way of example and not of limitation, but only in accordance with the scope of the appended claims.

I claim:

1. A flush tank system comprising:

a water storage tank having an outlet;

a flush valve in said outlet adapted to close to hold stored water in said tank, and to open to discharge said water through said outlet, said flush valve including a standpipe rising in said tank and discharging into said outlet, said standpipe having a peripheral wall with an upper end establishing an uppermost water level in said tank, and drain means in said peripheral wall at a repose level, said drain means draining water from said tank down to said repose level;

a tank valve mounted to said tank for receiving water to be supplied to said tank, and; having an open condition for supplying water to said tank and a closed condition preventing said supply; said tank valve including water level-responsive control means selected to establish said condition, said control means being bi-stable, and retaining the most recent condition pertaining to either a level higher than said repose level or a lower level respective to drainage of stored water from said tank to a predetermined lower level;

whereby with the flush valve closed and the tank valve open, water is continuously supplied to a preselected level above the repose level, at which event the water level responsive control means changes the tank valve to a closed condition and water drains through said drain means through said standpipe to said discharge outlet of said flush valve until the repose level has been reached, and the system remains in repose with both valves closed, with the tank valve remaining closed and opening only after the water level has lowered to a desired predetermined level, and said flush valve closing at a desired closure level.

2. A system according to claim 1 in which the uppermost level coincides with the upper end of the standpipe.

3. A system according to claim 1 in which said drain means is a slot extending from said upper end.

4. A system according to claim 1 in which the standpipe is adapted to raise or lower its upper end and drain means.

5. A system according to claim 4 in which said standpipe is slidably and sealingly mounted to said flush valve.

6. A system according to claim 4 in which said standpipe includes a flexible portion enabling it to flex to adjust the level of said upper end.

7. A system according to claim 4 in which said standpipe includes at least one re-entrantly foldable segment which enables the extension or reduction in length of said standpipe.

8. A system according to claim 4 in which said control means is a float linked to said valve, including a bi-stable element which retains said most recent condition.

9. A system according to claim 1 in which said control means is a float linked to said valve, including a bi-stable element which retains said most recent condition.

10. A system according to claim 9 in which said control includes privoted linkage and fork means effective at separate water levels.

11. In a flush valve for a water storage tank which tank has a tank outlet, said flush valve having a body mounted to the tank at said inlet, and including a valving member and seat to control flow of water from the tank through said outlet, and a stand pipe mounted to said body with its end rising in the tank to a height above the body with a central passage by-passing said valving member to discharge directly to said tank outlet, the improvement comprising: the standpipe including a section whose length is inherently changeable so as to raise or to lower the height of its upper end for varying the upper water level in the storage tank, said inherency comprising a plurality of peripheral foldable segments which inherently tend to remain either open or closed, whereby opening or closing each individual one of said foldable segments changes the length of the standpipe by an increment equal to the difference between the length of the opened or closed foldable segment.

12. Apparatus according to claim 11 in which an axial slot is formed in the said end of the standpipe.

* * * * *